US009073734B1

(12) United States Patent
Cates et al.

(10) Patent No.: US 9,073,734 B1
(45) Date of Patent: Jul. 7, 2015

(54) HOISTING APPARATUS

(75) Inventors: Ronald D. Cates, Athens, TX (US); David M. Wiegand, Palestine, TX (US); Eddie R. Bedre, Elkhart, TX (US)

(73) Assignee: Corn Crane LLC, Athens, TX (US)

( * ) Notice: Subject to any disclaimer, the term of this patent is extended or adjusted under 35 U.S.C. 154(b) by 44 days.

(21) Appl. No.: 13/605,435

(22) Filed: Sep. 6, 2012

Related U.S. Application Data

(60) Provisional application No. 61/573,467, filed on Sep. 6, 2011.

(51) Int. Cl.
*B66F 3/00* (2006.01)
*B66C 23/06* (2006.01)

(52) U.S. Cl.
CPC ..... *B66C 23/06* (2013.01)

(58) Field of Classification Search
CPC ..... A01M 31/02; F16G 11/12; A22B 5/06; B66D 1/04
USPC ..... 254/261, 262, 329, 334–338, 380; 212/260–263
See application file for complete search history.

(56) References Cited

U.S. PATENT DOCUMENTS

| | | | | | |
|---|---|---|---|---|---|
| 272,236 | A | * | 2/1883 | Glennon | 212/179 |
| 398,596 | A | * | 2/1889 | Enyeart | 254/221 |
| 484,042 | A | * | 10/1892 | Murphy et al. | 182/240 |
| 750,750 | A | * | 1/1904 | Chandler | 254/252 |
| 800,744 | A | * | 10/1905 | Kimbro et al. | 254/256 |
| 1,264,357 | A | * | 4/1918 | Willmer | 254/262 |
| 1,431,090 | A | * | 10/1922 | Beckwith | 254/261 |
| 1,456,143 | A | * | 5/1923 | Ness | 254/260 |
| 1,555,367 | A | * | 9/1925 | Hall | 254/251 |
| 2,023,790 | A | * | 12/1935 | Ormsby et al. | 212/202 |
| 2,549,120 | A | * | 4/1951 | Ormsby | 254/326 |
| 2,723,103 | A | * | 11/1955 | Glassmaker | 254/251 |
| 2,733,817 | A | * | 2/1956 | Couse | 212/294 |
| 2,820,561 | A | * | 1/1958 | Meagher | 414/607 |
| 3,336,999 | A | * | 8/1967 | McSwain | 182/20 |
| 3,568,797 | A | * | 3/1971 | Hardy | 182/142 |
| 3,587,886 | A | * | 6/1971 | Gano et al. | 14/718 |
| 3,599,812 | A | * | 8/1971 | Hasstedt et al. | 414/563 |
| 3,797,672 | A | * | 3/1974 | Vermette | 52/116 |
| 3,958,377 | A | * | 5/1976 | Milner, Jr. | 52/118 |
| 4,078,818 | A | * | 3/1978 | Donnelly | 280/418.1 |
| 4,347,914 | A | * | 9/1982 | Gary | 182/142 |
| 4,597,562 | A | * | 7/1986 | Joyce | 254/334 |
| 4,647,015 | A | * | 3/1987 | Pusl | 254/230 |
| 5,263,675 | A | * | 11/1993 | Roberts et al. | 248/219.4 |
| 5,332,063 | A | * | 7/1994 | Amacker | 182/116 |
| 5,435,412 | A | * | 7/1995 | Franklin et al. | 182/188 |
| 5,494,117 | A | * | 2/1996 | Aldridge | 173/28 |
| 5,562,180 | A | * | 10/1996 | Herzog et al. | 182/187 |
| 5,603,489 | A | * | 2/1997 | Regal | 254/378 |
| 5,607,143 | A | * | 3/1997 | Regal | 254/342 |
| 6,045,442 | A | * | 4/2000 | Bounds | 452/187 |

(Continued)

*Primary Examiner* — Emmanuel M Marcelo
*Assistant Examiner* — Michael Gallion
(74) *Attorney, Agent, or Firm* — R. Keith Harrison

(57) ABSTRACT

A hoisting apparatus includes an apparatus mounting bracket including a mount bracket plate and at least one bracket attachment assembly having a pair of gripper arms pivotally carried by the mount bracket plate. Each of the gripper arms has a plurality of gripper arm teeth. An arm tightening mechanism engages the gripper arms. A boom assembly is pivotally carried by the apparatus mounting bracket. A boom actuating assembly is carried by the apparatus mounting bracket and engages the boom assembly.

20 Claims, 5 Drawing Sheets

(56) References Cited

U.S. PATENT DOCUMENTS

| | | | | |
|---|---|---|---|---|
| 6,059,240 | A * | 5/2000 | Gorsuch | 248/219.4 |
| 6,189,866 | B1 * | 2/2001 | Harkins et al. | 254/332 |
| 6,202,868 | B1 * | 3/2001 | Murray | 212/294 |
| 6,202,964 | B1 * | 3/2001 | Thornhill | 248/219.4 |
| 6,471,269 | B1 * | 10/2002 | Payne | 294/99.1 |
| 6,578,823 | B1 * | 6/2003 | Johnson | 254/334 |
| 6,663,065 | B1 * | 12/2003 | Whittenburg | 248/219.1 |
| 6,684,812 | B1 * | 2/2004 | Tucker | 119/57.91 |
| 6,695,688 | B1 * | 2/2004 | Owen et al. | 452/187 |
| 6,739,964 | B2 * | 5/2004 | Gearhart | 452/187 |
| 7,086,433 | B1 * | 8/2006 | Serman | 144/34.1 |
| 7,191,732 | B2 * | 3/2007 | Neal, Jr. | 119/57.91 |
| 7,341,507 | B1 * | 3/2008 | Julian, Sr. | 452/192 |
| 7,350,769 | B1 * | 4/2008 | Dorzok | 254/261 |
| 7,458,563 | B1 * | 12/2008 | Liu | 254/334 |
| 7,913,980 | B1 * | 3/2011 | Cipriano | 254/393 |
| D679,454 | S * | 4/2013 | Moore, Jr. | D30/133 |
| 8,511,433 | B2 * | 8/2013 | Place | 182/133 |
| D718,410 | S * | 11/2014 | Woller | D22/199 |
| 2003/0228838 | A1 * | 12/2003 | Gearhart | 452/187 |
| 2005/0072631 | A1 * | 4/2005 | Tracey | 182/127 |
| 2006/0196435 | A1 * | 9/2006 | Bilinovich | 119/57.91 |
| 2008/0085669 | A1 * | 4/2008 | Burrows | 452/187 |
| 2009/0272709 | A1 * | 11/2009 | Nessner et al. | 212/270 |
| 2009/0308994 | A1 * | 12/2009 | Moore | 248/229.17 |
| 2011/0260127 | A1 * | 10/2011 | Surgeon et al. | 254/362 |

* cited by examiner

HOISTING APPARATUS

CROSS-REFERENCE TO RELATED APPLICATIONS

This application claims the benefit of U.S. provisional application No. 61/573,467, filed Sep. 6, 2011 and entitled "Corn Crane", which provisional application is incorporated by reference herein in its entirety.

FIELD

Exemplary embodiments of the disclosure generally relate to apparatuses for selectively raising heavy loads. More particularly, illustrative embodiments of the disclosure relate to a hoisting apparatus which is particularly suitable for selectively raising and lowering a wildlife feeder, wild game or other heavy object.

BACKGROUND

Outdoor pursuits such as wildlife management and hunting are popular pastimes around the world. The controlled feeding of wildlife or wild game is a crucial aspect of wildlife management and hunting. Conventional methods of feeding wildlife or game may require that a person carry a heavy bag containing feed up a ladder to an elevated wildlife feeder and then pour the contents of the bag into the feeder. Alternatively, pulleys or winches may be used to raise a wildlife feeder from the ground to dispense controlled quantities of feed from the feeder onto the ground at predetermined times. In some applications, a wildlife feeder may be manually suspended from a tree limb or a ground-supported structure such as a tripod or other multi-legged device. Each of these techniques, however, may require that the elevated feeder be accessed using a ladder or through the physically-demanding use of pulleys and ropes. Although some ground-supported structures may utilize a winch to hoist a feeder from the ground, the winch may require considerable physical exertion and strength to operate. Therefore, use of these techniques may be very laborious, time-consuming and counterproductive. Moreover, ground-supported structures may deter wildlife from the area in which the structures are deployed and/or may be vulnerable to destruction by wildlife such as hogs or browsing cattle.

Accordingly, a hoisting apparatus which is particularly suitable for selectively raising and lowering a wildlife feeder, wild game or other heavy object may be desirable for wildlife feeding, hunting and other applications.

SUMMARY

Illustrative embodiments of the disclosure are generally directed to a hoisting apparatus which is particularly suitable for selectively raising and lowering a wildlife feeder, wild game or other heavy object for wildlife feeding, hunting and other applications. An illustrative embodiment of the hoisting apparatus includes an apparatus mounting bracket including a mount bracket plate and at least one bracket attachment assembly having a pair of gripper arms pivotally carried by the mount bracket plate. Each of the gripper arms has a plurality of gripper arm teeth. An arm tightening mechanism engages the gripper arms. A boom assembly is pivotally carried by the apparatus mounting bracket. A boom actuating assembly is carried by the apparatus mounting bracket and engages the boom assembly.

BRIEF DESCRIPTION OF THE DRAWINGS

Exemplary embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
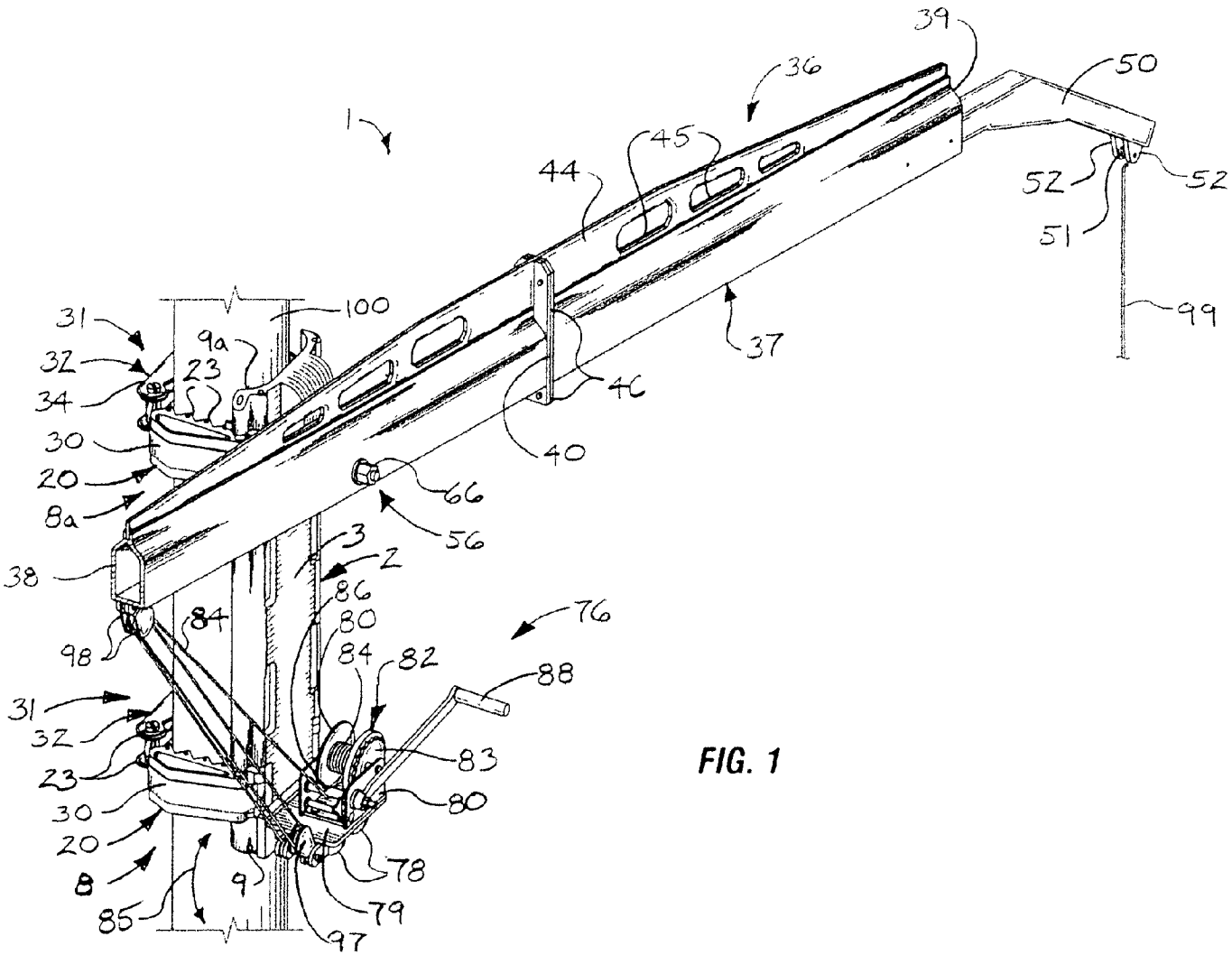
FIG. 1 is a perspective view of an exemplary embodiment of the hoisting apparatus, mounted on a vertical support in illustrative application of the apparatus.

Referring to the drawings, an illustrative embodiment of the hoisting apparatus is generally indicated by reference numeral 1 in FIG. 1. In exemplary application, which will be hereinafter described in detail, the hoisting apparatus 1 can be readily attached to a tree, post, pole or other vertical or non-vertical support structure 100 (FIGS. 1 and 4) without structural modification to the support structure 100. The mounted hoisting apparatus 1 can be operated to selectively raise and lower a feed-dispensing wildlife feeder, wild game or other heavy object (not illustrated) from the ground to a desired height above the ground. The hoisting apparatus 1 has the capability to secure the object at the raised position and facilitate selective lowering of the object back to the ground, as desired. Raising and lowering of the object can be performed in an effortless, simple, safe and user-friendly manner. The hoisting apparatus 1 can be placed at any height on the support structure 100 depending on the desired height for the feeder. Moreover, the support structure 100 to which the hoisting apparatus 1 is attached can be oriented at any angle vertical through horizontal.

As illustrated in FIG. 1, the hoisting apparatus 1 includes an apparatus mounting bracket 2 which is adapted for attachment to the support structure 100. A boom assembly 36 is pivotally supported by the apparatus mounting bracket 2. A boom actuating assembly 76 is supported by the apparatus mounting bracket 2 typically beneath the boom assembly 36. The boom actuating assembly 76 operably engages the boom assembly 36 to selectively pivot the boom assembly 36 on the apparatus mounting bracket 2 for selective hoisting or raising and lowering of an object (not illustrated) attached to the boom assembly 36 as will be hereinafter further described. The various components of the apparatus mounting bracket 2, the boom assembly 36 and the boom actuating assembly 76 may be aluminum, steel, composite materials and/or other suitable materials which are known by those skilled in the art and are consistent with the functional requirements of those components in operation of the hoisting apparatus 1. In some embodiments, the apparatus mounting bracket 2 may be fabricated as a solid extrusion, cast or forging.

Figure 4:
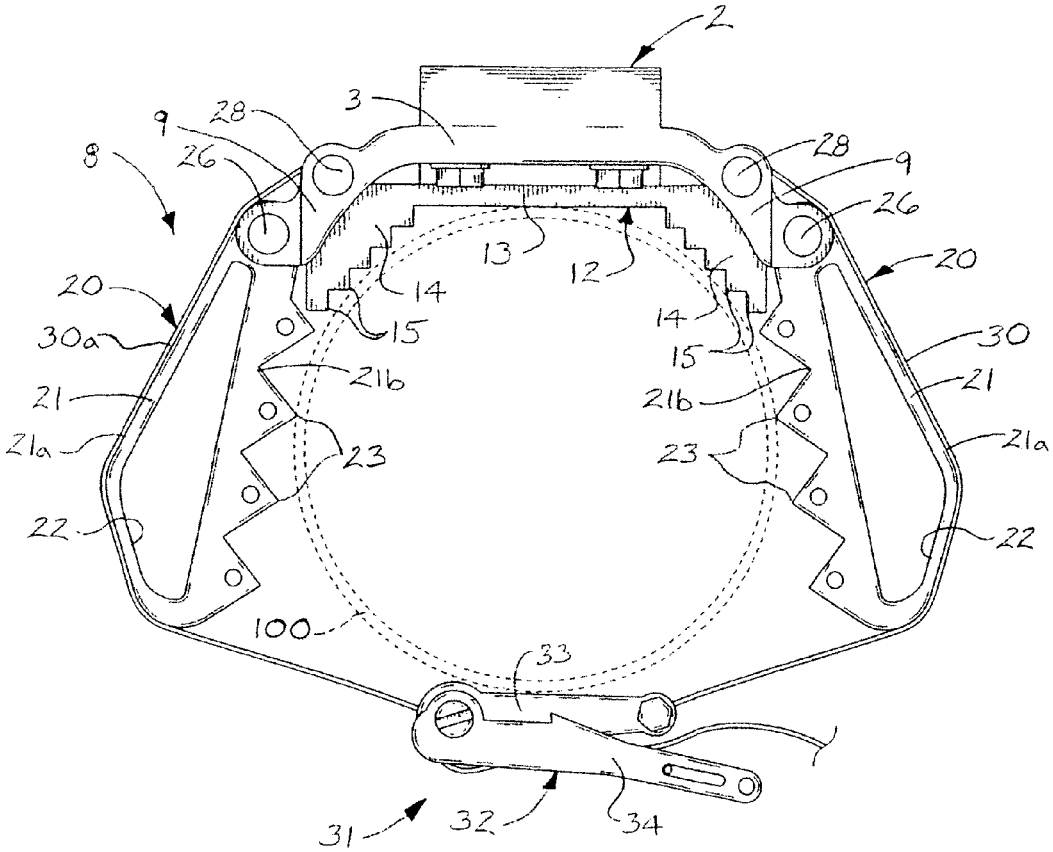
FIG. 4 is a top view of an apparatus mounting bracket suitable for fastening the hoisting apparatus to a support structure, typically vertically aligned but also including non vertical structures such as a tree, pole or post, whether it be man-made or occurring naturally in nature (illustrated in phantom)

The apparatus mounting bracket 2 may include a mount bracket plate 3. As illustrated in FIG. 1, in some embodiments, the mount bracket plate 3 may be generally elongated and rectangular. The mount bracket plate 3 may also vary in thickness as determined by those skilled in the art and are consistent with the functional requirements of those components in operation of the hoisting apparatus 1. In other embodiments, the mount bracket plate 3 may have alternative shapes. At least one bracket attachment assembly 8 may be provided on the mount bracket plate 3. As illustrated in FIG. 1, in some embodiments, a lower bracket attachment assembly 8 and an upper bracket attachment assembly 8*a* may be provided on the mount bracket plate 3. As illustrated in FIG. 4, the lower bracket attachment assembly 8 and the upper bracket attachment assembly 8*a* may each include a pair of spaced-apart bracket assembly mount arms 9 which extend from opposite sides of the mount bracket plate 3.

A gripper bracket 12 may be provided between the bracket assembly mount arms 9. The gripper bracket 12 may be fabricated in various sizes and shapes to accommodate support structures 100 of different diameters. In some embodiments, the gripper bracket 12 may be releasably attached to the mount bracket plate 3. Therefore, the gripper bracket 12 can be used to grip support structures 100 having smaller diameters and can be omitted from the mount bracket plate 3 in circumstances in which the apparatus mounting bracket 2 is to be attached to support structures 100 having larger diameters. The gripper bracket 12 may include a gripper bracket body 13 which is attached to the mount bracket plate 3 such as via bolting, welding and/or other suitable attachment technique. A pair of spaced-apart gripper bracket arms 14 may extend from opposite sides of the gripper bracket body 13. Each gripper bracket arm 14 may have multiple gripper bracket teeth 15. As further illustrated in FIG. 4, the gripper bracket teeth 15 may have a stepped configuration from the gripper bracket body 13 to the end of each gripper bracket arm 14. In mounting of the apparatus mounting bracket 2 on the support structure 100, the gripper bracket teeth 15 engage the exterior surface of the support structure 100, as illustrated in FIG. 4 and will be hereinafter described. A pair of strap anchor pins 28 may be provided on the respective bracket assembly mount arms 9 for purposes which will be hereinafter described.

A pair of gripper arms 20 is pivotally attached to the respective bracket assembly mount arms 9. Each gripper arm 20 may include a generally elongated gripper arm frame 21 having an outer frame surface 21*a* and an inner frame surface 21*b*. The gripper arm frame 21 may be pivotally attached to the corresponding bracket assembly mount arm 9 via a gripper arm hinge pin 26. The gripper arm frame 21 of each gripper arm 20 may have a generally elongated frame opening 22. In some embodiments, the outer frame surface 21*a* of each gripper arm frame 21 may be generally convex, as illustrated. Multiple gripper arm teeth 23 may be provided in the inner frame surface 21*b* of the gripper arm frame 21. Accordingly, each gripper arm 20 can be selectively pivoted about the gripper arm hinge pin 26 on the corresponding bracket assembly mount arm 9 between an outwardly-deployed release position (not illustrated) and the inwardly-deployed gripping position illustrated in FIG. 4. In the gripping position, the gripper arm teeth 23 engage the corresponding side of the support structure 100, as further illustrated in FIG. 4, to secure the apparatus mounting bracket 2 to the support structure 100.

An arm tightening mechanism 31 may engage the gripper arms 20 of each of the lower bracket attachment assembly 8 and the upper bracket assembly 8*a* to secure the gripper arms 20 in the inwardly-deployed gripping position illustrated in FIG. 4. The arm tightening mechanism 31 may have any design which is known by those skilled in the art and is suitable for the purpose of securing or tightening the gripper arms 30, 30*a* against the support structure 100. In some embodiments, the arm tightening mechanism 31 may include a ratchet mechanism 32. The ratchet mechanism 32 may have a standard or conventional ratchet mechanism design with a ratchet frame 33 and a ratchet handle 34 which pivots with respect to the ratchet frame 33. A first ratchet strap 30 has a first ratchet strap end (not illustrated) which is attached to the strap anchor pin 28 on the corresponding side of the apparatus mounting bracket 2. The first ratchet strap 30 engages the outer frame surface 21*a* of the corresponding gripper arm 20. A second ratchet strap end (not illustrated) of the first ratchet strap 30 is attached to the ratchet frame 33 of the ratchet mechanism 32. A second ratchet strap 30*a* has a first ratchet strap end (not illustrated) which is attached to the strap anchor pin 28 on the corresponding side of the apparatus mounting bracket 2. The second ratchet strap 30*a* engages the outer frame surface 21*a* of the corresponding gripper arm 20. A second ratchet strap end (not illustrated) of the second ratchet strap 30*a* is wound on a ratchet spool (not illustrated) in the ratchet mechanism 32.

Accordingly, the ratchet handle 34 can be selectively and repeatedly pivoted with respect to the ratchet frame 33 of the ratchet mechanism 32 to progressively wind the second ratchet strap 30*a* on the ratchet spool and tighten the first ratchet strap 30 and the second ratchet strap 30*a* against the respective gripper arms 20, typically in the conventional manner. This ratcheting action tightens the gripper arm teeth 23 on the respective gripper arms 20 against the support structure 100, securing the apparatus mounting bracket 2 on the support structure 100. The gripper arms 20 can be selectively released by reverse operation of the ratchet mechanism 32 typically in the conventional manner. It will be appreciated by those skilled in the art that the pivoting capability of the gripper arms 20 relative to the bracket assembly mount arms 9 facilitate their secure engagement with support structures 100 having various diameters. It will be further appreciated by those skilled in the art that the convexity of the outer frame surface 21*a* of each gripper arm 20 directs the vector of force from the ratchet strap 30 into the gripper arm teeth 23, enhancing the gripping capability of the gripper arms 20. In some embodiments, the ratchet mechanism 32 may have a dual ratchet mechanism design which is known by those skilled in the art to equalize the forces while pulling the first ratchet strap 30 and the second ratchet strap 30*a* around the support structure 100.

Figure 2:
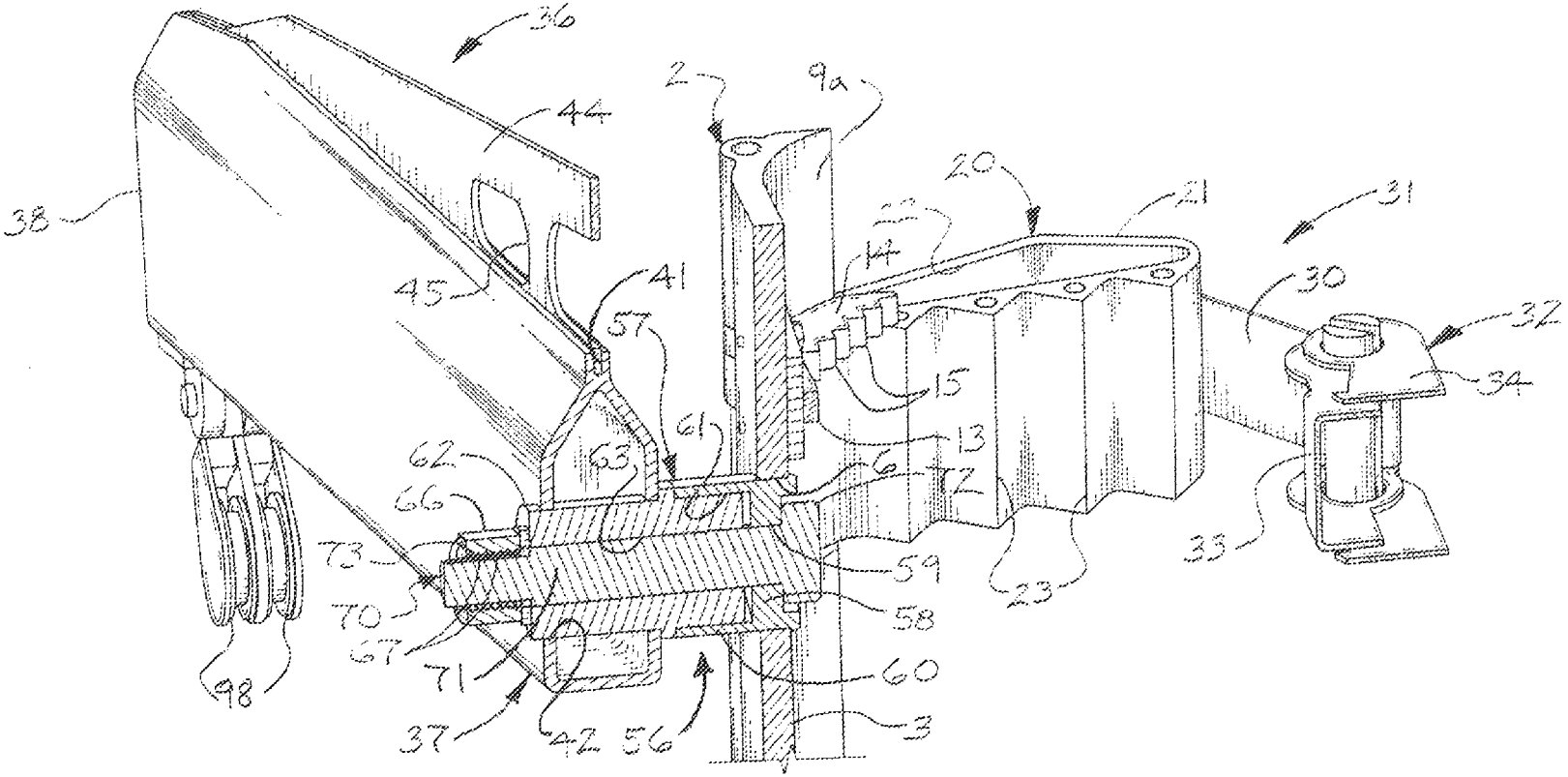
FIG. 2 is a sectioned perspective view of an illustrative fulcrum in attachment of a boom assembly to an apparatus mounting bracket according to an exemplary embodiment of the hoisting apparatus.

As illustrated in FIG. 1, the boom assembly 36 includes an elongated boom arm 37 which is pivotally attached to the apparatus mounting bracket 2 via a boom fulcrum 56. The boom arm 37 may have a proximal arm end 38, a distal arm end 39 and an arm midpoint 40 substantially equidistant between the proximal arm end 38 and the distal arm end 39. As illustrated in FIG. 2, an upper edge portion of the boom arm 37 may have a generally inverted conical or tapered cross-sectional shape. A boom stabilizing flange 44 may extend along an upper surface of the boom arm 37. As illustrated in FIG. 2, in some embodiments, a boom flange groove 41 may be provided along the upper surface of the boom arm 37. The boom stabilizing flange 44 may be detachably or permanently inserted in the boom flange groove 41. In some embodiments, multiple flange openings 45 may extend through the boom stabilizing flange 44. The flange openings 45 may decrease resistance of the boom stabilizing flange 44 to crosswinds by providing passage of the crosswinds through the flange openings 45, enhancing stability of the boom arm 37. As illustrated in FIG. 1, gussets 46 may stabilize the boom arm 37 and the boom stabilizing flange 44 generally at the arm midpoint 40 of the boom arm 37. The boom fulcrum 56 may be located between the proximal arm end 38 and the arm midpoint 40 of the boom arm 37. In some embodiments, the boom fulcrum 56 may be located approximately midway between the proximal arm end 38 and the arm midpoint 40 of the boom arm 37, as illustrated. This position of the boom fulcrum 56 approximately midway between the proximal arm end 38 and the arm midpoint 40 may provide the optimum combination to ease cranking effort and effect maximum height of the boom arm 37.

In some embodiments, a terminal boom segment 50 may protrude from the distal arm end 39 of the boom arm 37. The terminal boom segment 50 may curve generally downwardly and outwardly from the distal arm end 39. A pair of spaced-apart cable attachment flanges 52 may be provided on the terminal boom segment 50. In operation of the hoisting apparatus 1, which will be hereinafter described, a hoisting cable 99 is attached to the cable attachment flanges 52 to facilitate hoisting operations as the boom arm 37 pivots with respect to the apparatus mounting bracket 2 responsive to operation of the boom actuating assembly 76. The terminal boom segment 50 extends sufficiently out from the bottom of the boom arm 37 such as to hold a feeder (not illustrated) which is attached to the hoisting cable 99 out away from the boom arm 37 at the maximum height of the boom arm 37.

The boom fulcrum 56 which pivotally attaches the boom arm 37 to the apparatus mounting bracket 2 may have any design which is suitable for the purpose. An illustrative boom fulcrum 56 which is suitable for the purpose is illustrated in FIG. 2. Accordingly, in some embodiments, the boom fulcrum 56 includes a fulcrum collar 57. The fulcrum collar 57 includes an annular or disc-shaped fulcrum collar body 58 through which extend a fulcrum bolt opening 59. An annular fulcrum collar wall 60 extends from the fulcrum collar body 58. The fulcrum collar wall 60 forms an annular collar opening 61. The fulcrum collar body 58 of the fulcrum collar 57 protrudes through a fulcrum collar opening 6 which extends laterally through the mount bracket plate 3 of the apparatus mounting bracket 2.

A generally elongated, cylindrical fulcrum bearing 62 has a first end which is inserted in the collar opening 61 formed by the fulcrum collar wall 60 of the fulcrum collar 57. The remaining portion of the fulcrum bearing 62 which protrudes from the collar opening 61 inserts through a fulcrum bearing opening 42 that extends laterally through the boom arm 37 of the boom assembly 36. The boom arm 37 may be welded and/or otherwise attached to the fulcrum bearing 62. A fulcrum bolt opening 63 may extend through the fulcrum bearing 62. The fulcrum bolt opening 63 in the fulcrum bearing 62 registers with the fulcrum bolt opening 59 in the fulcrum collar body 58 of the fulcrum collar 57. A fulcrum bolt 70 includes an elongated threaded fulcrum bolt shank 71 and a fulcrum bolt head 72 on the fulcrum bolt shank 71. Exterior bolt threads 73 may be provided on the fulcrum bolt shank 71. The fulcrum bolt shank 71 extends through the fulcrum bolt opening 59 in the fulcrum collar body 58 of the fulcrum collar 57 and the registering fulcrum bolt opening 63 in the fulcrum bearing 62. A lock nut 66 having interior nut threads may be threaded on the fulcrum bolt threads 73 on the fulcrum bolt 70 and tightened against the fulcrum bearing 62. Accordingly, as the boom arm 37 pivots at the boom fulcrum 56, the fulcrum bearing 62 rotates with the boom arm 37 relative to the fulcrum bolt 70.

Figure 3:
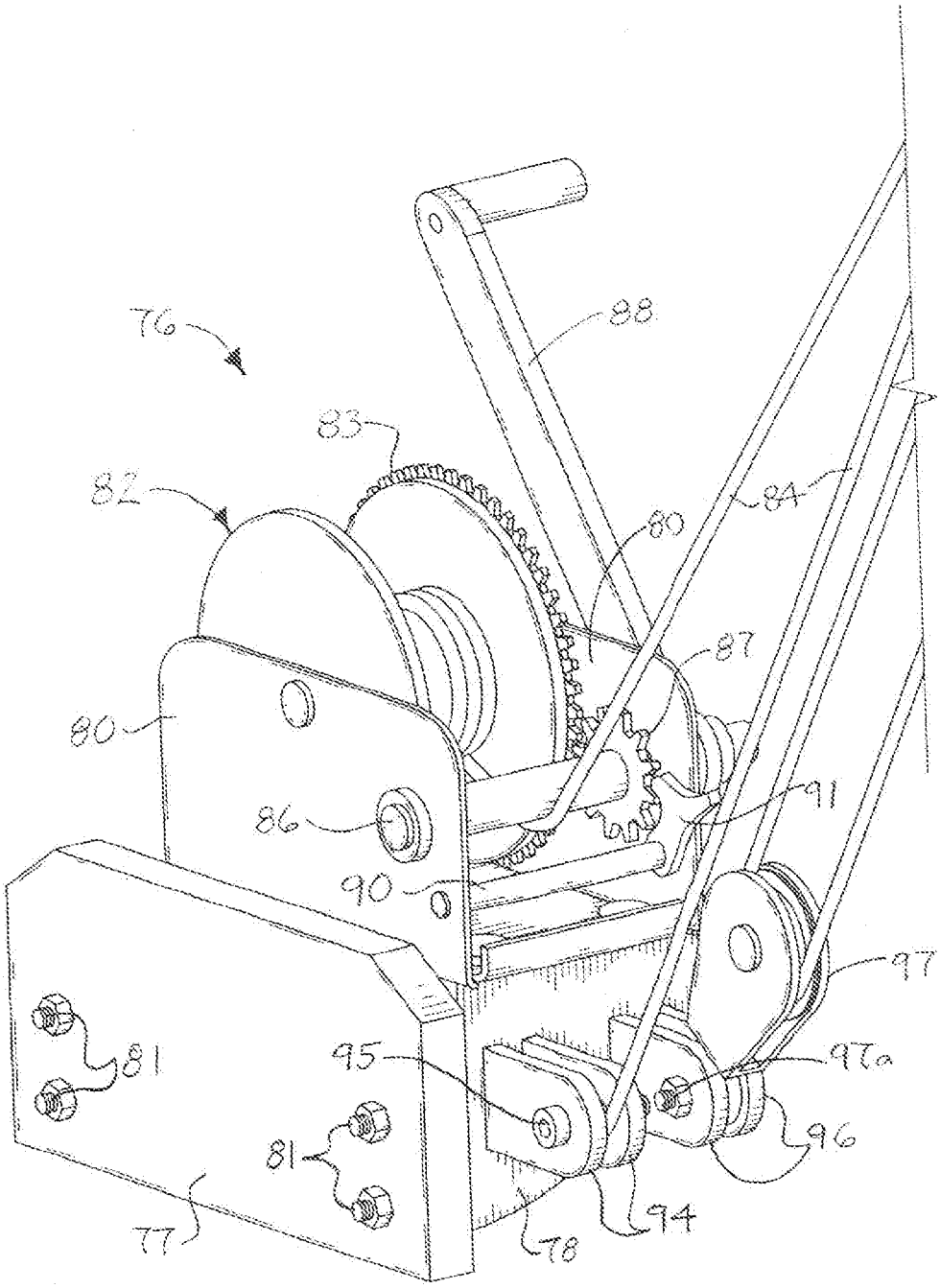
FIG. 3 is a perspective view of an illustrative boom actuating assembly according to an exemplary embodiment of the hoisting apparatus.

As illustrated in FIG. 1, the boom actuating assembly 76 of the hoisting apparatus 1 may be mounted on the apparatus mounting bracket 2 generally beneath the boom assembly 36. The boom actuating assembly 76 may have any design which is suitable for the purpose of pivoting the boom assembly 36 on the apparatus mounting bracket 2 about the boom fulcrum 56 to raise and lower the terminal boom segment 50 of the boom arm 37. An illustrative boom actuating assembly 76 which is suitable for the purpose is illustrated in FIG. 3. Accordingly, in some embodiments, an assembly mount plate 77 may be attached to the mount bracket plate 3 of the apparatus mounting bracket 2 such as using plate mount bolts 81 (FIG. 3), for example and without limitation. A pair of spaced-apart platform brackets 78 (one of which is illustrated in FIG. 3) may extend from the assembly mount plate 77. An assembly mount platform 79 (FIG. 1) may be supported by the platform brackets 78. A pair of generally parallel, spaced-apart spool mount flanges 80 is upward-standing from the assembly mount platform 79. A rotatable winch spool 82 is mounted between the spool mount flanges 80. The winch spool 82 is fitted with a toothed winch spool sprocket 83.

A rotatable crank shaft 86 is mounted between the spool mount flanges 80. A toothed crank shaft sprocket 87 is provided on the crank shaft 86. The teeth of the crank shaft sprocket 87 mesh with the teeth of the winch spool sprocket 83. A crank handle 88 drivingly engages the crank shaft 86. Accordingly, rotation of the crank shaft handle 88 causes rotation of the winch spool 82 through the crank shaft sprocket 87 on the crank shaft 86 and the winch spool sprocket 83 on the winch spool 82. A rotatable pawl shaft 90 may be mounted between the spool mount flanges 80. A pawl 91 is provided on the pawl shaft 90. The pawl 91 is adapted to selectively engage the teeth on the crank shaft sprocket 87 and prevent further rotation of the winch spool 82 and the crank handle 88, for purposes which will be hereinafter described.

A winch cable 84 is wound on the winch spool 82 of the boom actuating assembly 76. The winch cable 84 connects the winch spool 82 to the boom arm 37 of the boom assembly 36 in such a manner that rotation of the crank handle 88 of the boom actuating assembly 76 in a first direction raises the terminal boom segment 50 of the boom arm 37 whereas rotation of the crank handle 88 in a second direction lowers the terminal boom segment 50. Various pulleys around which the winch cable 84 is trained may be provided on the boom assembly 36 and the boom actuating assembly 76 to facilitate this purpose. An exemplary system or arrangement of pulleys which is suitable for the purpose is illustrated in FIGS. 1 and 3. However, it will be recognized and understood by those skilled in the art that various alternative arrangements of pulleys may be used to facilitate the purpose of selectively raising and lowering the terminal boom segment 50 of the boom arm 37 via the winch cable 84 by rotation of the crank handle 88. Accordingly, in some embodiments, a single platform pulley 97 may be provided on the boom actuating assembly 76 and a double boom pulley 98 may be provided on the boom arm 37. As illustrated in FIG. 3, the single platform pulley 97 may be provided on a platform bracket 78 of the boom actuating assembly 76. The platform pulley 97 may be mounted between a pair of spaced-apart pulley flanges 96 which extends from the platform bracket 78. A platform pulley bolt 97*a* may be extended through registering bolt openings (not illustrated) in the pulley flanges 96 and through a registering bolt opening (not illustrated) in the platform pulley 97. As illustrated in FIG. 1, the double boom pulley 98 may be attached to the proximal arm end 38 of the boom arm 37 in a similar manner.

The winch cable 84 has a first winch cable end (not illustrated) which may be attached to the winch spool 82 of the boom actuating assembly 76 using a suitable cable attachment technique known by those skilled in the art. As illustrated in FIG. 3, the winch cable 84 is wound on and then extends from the winch spool 82 above or below the crank shaft 86. From the crank shaft 86, the winch cable 84 extends upwardly to and is trained around one side of the double boom pulley 98 at the proximal arm end 38 of the boom arm 37. From the boom pulley 98, the winch cable 84 extends downwardly to and is trained around the single platform pulley 97. From the platform pulley 97, the winch cable 84 extends upwardly to and is trained around the other side of the boom pulley 98. Finally, the winch cable 84 extends from the boom pulley 98 downwardly to the cable anchor flanges 94, between which the second cable end (not illustrated) of the winch cable 84 is secured via a bolt 95 or other suitable cable attachment technique, as illustrated in FIG. 3. Accordingly, rotation of the crank handle 88 on the boom actuating assembly 76 in the clockwise direction causes the winch spool 82 to rotate in the counterclockwise direction such that the winch cable 84 is wound on the winch spool 82. This action shortens the winch cable 84 between the boom actuating assembly 76 and the boom arm 37 of the boom assembly 36, lowering the proximal arm end 38 and raising the distal arm end 39 and the terminal boom segment 50 of the boom arm 37 as well as the hoisting cable 99 attached to the terminal boom segment 50 as the boom assembly 36 pivots at the boom fulcrum 56. Conversely, rotation of the crank handle 88 in the counterclockwise direction causes the winch spool 82 to rotate in the clockwise direction such that the winch cable 84 is unwound from the winch spool 82. This action lengthens the winch cable 84 between the boom actuating assembly 76 and the boom arm 37 of the boom assembly 36 such that the distal arm end 39 and the terminal boom segment 50 of the boom arm 37 as well as the hoisting cable 99 attached to the terminal boom segment 50 are lowered via gravity; raising the proximal arm end 38 as the boom assembly 36 pivots at the boom fulcrum 56.

In alternative embodiments of the hoisting apparatus 1, the boom actuating assembly 76 may be a solar-powered or battery powered motorized winch of conventional design known by those skilled in the art. In some embodiments, the boom actuating assembly 76 may include a double brake winch which is known by those skilled in the art. As illustrated in FIG. 1, in some embodiments, the boom actuating assembly 76 may have an adjustable or pivotal positioning capability to accommodate mounting of the hoisting apparatus 1 to a support structure 100 which may be horizontal, diagonal or other vertical or non-vertical position such as a limb or diagonal trunk, for example and without limitation. The boom actuating assembly 76 may be pivotally attached to the apparatus mounting bracket 2 such that the boom actuating assembly 76 pivots in a plane which is parallel to the plane of the apparatus mounting bracket 2, as indicated by the arrow 85 in FIG. 1.

In exemplary application, the hoisting apparatus 1 is operated to raise and lower a feed-dispensing wildlife feeder, wild game or other heavy object (not illustrated) from the ground to a desired height above the ground in the management, pursuit or attraction of wildlife. For example, in some applications the hoisting apparatus 1 can be operated to lift a wildlife feeder to a selected height above the ground to dispense wildlife feed from the feeder onto the ground for hunting, wildlife observation or other purposes. In other applications, the hoisting apparatus 1 can be operated to lift a wild game carcass to a selected height to field dress the game. As will be apparent from a consideration of the following description, the hoisting apparatus 1 is amenable to a variety of other applications.

The apparatus mounting bracket 2 is initially attached to a support structure 100 such as a tree, post or pole, for example and without limitation. The lower bracket attachment assembly 8 and the upper bracket attachment assembly 8*a* are fastened to the support structure 100 by tightening the first ratchet strap 30 and the second ratchet strap 30*a* around the support structure 100 by operation of the arm tightening mechanism 31, as was heretofore described with respect to FIG. 4. Accordingly, the gripper bracket teeth 15 on the gripper bracket arms 14 of the gripper bracket 12 and the gripper arm teeth 23 on the gripper arms 20 engage the support structure 100 and secure the apparatus mounting bracket 2 on the support structure 100 at a selected height above the ground. In some embodiments, one or more lag bolt openings (not illustrated) may extend through the mount bracket plate 3 of the apparatus mounting bracket 2. Lag bolts (not illustrated) can be extended through the lag bolt openings and threaded into the support structure 100 to enhance stability of the apparatus mounting bracket 2 on the support structure 100 and for long-term installation.

After the apparatus mounting bracket 2 is attached to the support structure 100, the boom actuating assembly 76 is operated to lower the distal arm end 39 and the terminal boom segment 50 of the boom arm 37 toward the ground. Accordingly, the crank handle 88 may be rotated in the counterclockwise direction with reference to FIGS. 1 and 3 to unwind the winch cable 84 from the winch spool 82. This action lengthens the runs of the winch cable 84 between the boom actuating assembly 76 and the proximal arm end 38 of the boom assembly 36, lowering the distal arm end 39 and the terminal boom segment 50 by gravity as the boom arm 37 pivots at the boom fulcrum 56. The wildlife feeder, wild game or other heavy object (not illustrated) is attached to the lowered hoisting cable 99. Next, the boom actuating assembly 76 is operated to lower the proximal arm end 38 and raise the distal arm end 39, the terminal boom segment 50 and the hoisting cable 99 such that the hoisting cable 99 lifts the object (not illustrated) attached to the hoisting cable 99 from the ground. Accordingly, the crank handle 88 may be rotated in the clockwise direction to wind the winch cable 84 onto the winch spool 82. This action shortens the runs of winch cable 84 between the boom actuating assembly 76 and the proximal arm end 38 of the boom assembly 36, raising the distal arm end 39 and the terminal boom segment 50 as the boom arm 37 pivots at the boom fulcrum 56. Therefore, the terminal boom segment 50 raises the hoisting cable 99, which raises the object attached to the hoisting cable 99 from the ground. The height above the ground to which the object is raised can be selected according to the number of rotations of the crank handle 88 as well as by the height at which the hoisting apparatus 1 is mounted on the support structure 100. As illustrated in FIG. 3, after the object has reached the desired height, the pawl 91 may be engaged with the teeth on the crank shaft sprocket 87, preventing rotation of the winch spool 82 and raising or lowering of the hoisting cable 99. When it is desired to subsequently lower the object to the ground or to a selected height, the pawl 91 can be disengaged from the crank shaft sprocket 87 and the boom actuating assembly 76 operated in reverse to lower the object, the hoisting cable 99 and the terminal boom segment 50 to the ground or to the selected height.

It will be appreciated by those skilled in the art that the hoisting apparatus 1 is highly portable, adaptable and lightweight to provide a user with a stable, manageable and safe way to feed wildlife in the management, pursuit or attraction of the wildlife. The hoisting apparatus 1 can be operated to lift a wildlife feeder from ground level to an elevated position of any desired height in a manner that is effortless, simple, safe and user friendly. In the event that a squirrel, raccoon or other animal is able to scale the support structure 100 and reach the boom assembly 36, the boom stabilizing flange 44, as well as the tapered or conical shape of the upper edge of the boom arm 37, prevents the animal from traversing the top of the boom arm 37 to access the feeder. The height at which the hoisting apparatus 1 is mounted on the support structure 100 allows for virtually unlimited options on the final height of the wildlife feeder or other object which is to be hoisted using the apparatus. The hoisting apparatus 1 can be fabricated using relatively few parts, allowing for simplicity, longevity, durability, strength and lightweight construction. Fabrication techniques may include extrusion, milling, water jetting, forging, casting, CNC plasma cutting, CNC turret punching and manual punching, for example and without limitation. In some embodiments, black iodization and/or powder coating may be utilized on the surfaces of the components for aesthetics and durability. As the boom arm 37 pivots relative to the apparatus mounting bracket 2 in raising and lowering of the terminal boom segment 50, the design of the boom fulcrum 56 facilitates secure attachment, minimal friction with movement, added stability by minimizing lateral and other undesired vectored forces and maximizing leverage used in raising the terminal boom segment 50 of the boom assembly 36.

Figure 5:
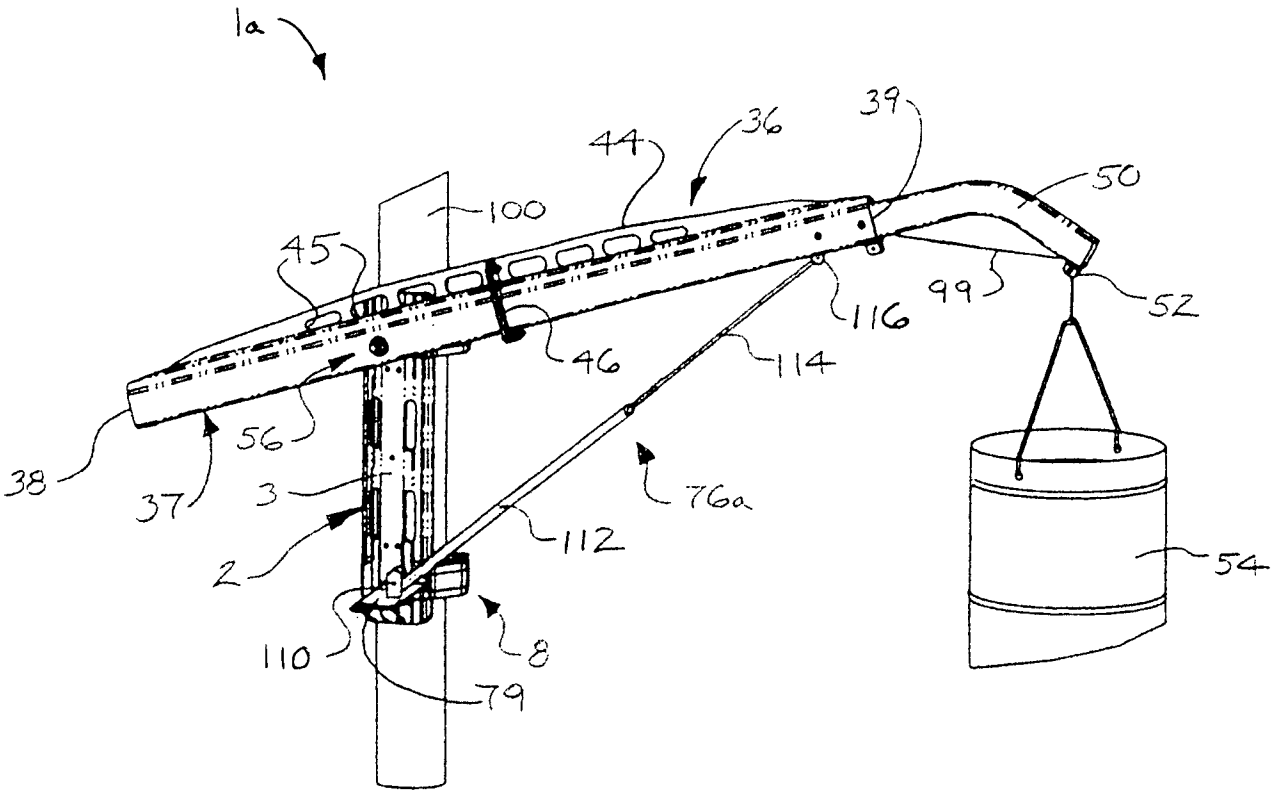
FIG. 5 is a perspective view of an alternative illustrative hydraulic piston-actuated embodiment of the hoisting apparatus.

Referring next to FIG. 5 of the drawings, an alternative illustrative embodiment of the hoisting apparatus 1*a* includes a boom actuating assembly 76*a* having a hydraulic boom actuating cylinder 112. The boom actuating cylinder 112 may be pivotally mounted between a pair of cylinder mount flanges 110 upward-standing from the assembly mount platform 79. A hydraulic pump and supply mechanism (not illustrated) may be connected to the boom actuating cylinder 112 in the conventional manner. A boom actuating piston 114 is selectively extendable from the boom actuating cylinder 112 responsive to introduction of hydraulic fluid into the boom actuating cylinder 112. The distal or extending end of the boom actuating piston 114 may be pivotally mounted between a pair of piston attachment flanges 116 on the underside of the boom arm 37 of the boom assembly 36. Accordingly, actuation of the boom actuating assembly 76*a* by pressurization of hydraulic fluid in the boom actuating cylinder 112 facilitates selective extension of the boom actuating piston 114 from the boom actuating cylinder 112. The extending boom actuating piston 114 raises the distal arm end 39 of the boom arm 37, lifting the terminal boom segment 50 and the hoisting cable 99 and a wildlife feeder 54 or other object attached to the terminal boom segment 50 as the boom arm 37 pivots at the boom fulcrum 56. Release of hydraulic fluid pressure in the boom actuating cylinder 112 facilitates retraction of the boom actuating piston 114 into the boom actuating cylinder 112 and lowering of the terminal boom segment 50 and the wildlife feeder 54 attached to the hoisting cable 99 under influence of gravity.

While the embodiments of the disclosure have been described above, it will be recognized and understood that various modifications can be made and the appended claims are intended to cover all such modifications which may fall within the spirit and scope of the disclosure.

What is claimed is:

1. A hoisting apparatus, comprising:

an apparatus mounting bracket including:

an elongated mount bracket plate having upper and lower ends and longitudinal axis; and at least one bracket attachment assembly having:

a pair of gripper arms pivotally carried by the mount bracket plate and each having a plurality of gripper arm teeth, the pair of gripper arms disposed in a plane perpendicular to the longitudinal axis of the mount bracket plate; and an arm tightening mechanism engaging the gripper arms;

a boom assembly pivotally carried by the apparatus mounting bracket; and a boom actuating assembly carried by the apparatus mounting bracket at the lower end of the mount bracket plate and beneath the boom assembly, the boom actuating assembly engaging the boom assembly, the boom actuating assembly operable to selectively pivot the boom assembly on the apparatus mounting bracket;

a boom fulcrum pivotally attaching the boom arm to the apparatus mounting bracket between the arm midpoint and the proximal arm end.

2. The hoisting apparatus of claim 1 further comprising a gripper bracket having a gripper bracket body carried by the mount bracket plate, a pair of spaced-apart gripper bracket arms carried by the gripper bracket body and a plurality of gripper bracket teeth provided in each of the gripper bracket arms.

3. The hoisting apparatus of claim 1 further comprising a pair of spaced-apart bracket assembly mount arms carried by the mount bracket plate and wherein the gripper arms are pivotally carried by the pair of spaced-apart bracket assembly mount arms, respectively; wherein the arm tightening mechanism comprises at least one ratchet strap engaging the gripper arms and a ratchet mechanism operably engaging the at least one ratchet strap; and further comprising at least one strap anchor pin carried by the mount bracket plate and wherein the at least one ratchet strap is attached to the at least one strap anchor pin.

4. The hoisting apparatus of claim 3 wherein each of the gripper arms comprises a generally elongated gripper arm frame pivotally carried by the mount bracket plate, the gripper arm frame having an inner frame surface and a generally convex outer frame surface, and a plurality of gripper arm teeth provided on the inner frame surface of the gripper arm frame, and wherein the at leant one ratchet strap engages the outer frame surface.

5. The hoisting apparatus of claim 1 wherein the boom actuating assembly comprises a boom actuating cylinder carried by the apparatus mounting bracket and a boom actuating piston extendable from the boom actuating cylinder and engaging the boom assembly.

6. The hoisting apparatus of claim 1 wherein the boom actuating assembly comprises a winch spool carried by the apparatus mounting bracket and a winch cable wound on the winch spool and attached to the boom assembly.

7. The hoisting apparatus of claim 1 wherein the boom actuating assembly is pivotally carried by the apparatus mounting bracket.

8. The hoisting apparatus of claim wherein the boom assembly comprises an elongated boom arm pivotally carried by the apparatus mounting bracket, the boom arm having a tapered upper edge portion in cross-section, and an elongated boom stabilizing flange extending along the tapered upper edge portion of the boom arm.

9. A hoisting apparatus, comprising:

an apparatus mounting bracket including:

an elongated mount bracket plate having upper and lower ends and a longitudinal axis; and at least one bracket attachment assembly having:

a pair of gripper arms pivotally carried by the mount bracket plate and each having a plurality of gripper arm teeth, the pair of gripper arms disposed in a plane perpendicular to the longitudinal axis of the mount bracket plate;

a first bracket assembly mount arm carried by the mount bracket plate and extending beyond a first side edge of the mount bracket plate;

a second bracket assembly mount arm by the mount bracket plate and extending beyond a second side edge of the mount bracket plate; and wherein the pair of gripper arms includes a first gripper arm pivotally carried by the first bracket assembly mount arm and a second gripper arm pivotally carried by the second bracket assembly mount arm; and an arm tightening mechanism engaging the first and second gripper arms;

a boom assembly including:

an elongated boom arm pivotally carried by the apparatus mounting bracket and having a proximal arm end, a distal arm end and an arm midpoint substantially midway between the proximal arm end and the distal arm end;

a hoisting cable carried by the distal arm end of the boom arm; and a boom fulcrum pivotally attaching the boom arm to the apparatus mounting bracket between the arm midpoint and the proximal arm end; and a boom actuating assembly carried by the apparatus mounting bracket at the lower end of the mount bracket plate and beneath the boom assembly, the boom actuating assembly operably engaging the boom assembly to selectively pivot the boom assembly about the boom fulcrum.

10. The hoisting apparatus of claim 9 wherein the boom fulcrum comprises a fulcrum collar carried by the mount bracket plate of the apparatus mounting bracket; an elongated, cylindrical fulcrum bearing inserted in the fulcrum collar: a fulcrum bolt extending through registering bolt openings in the fulcrum collar and the fulcrum bearing, respectively; and a fulcrum bearing opening extending laterally through the boom arm of the boom assembly and accommodating the fulcrum bearing.

11. The hoisting apparatus of claim 9 further comprising a gripper bracket having a gripper bracket body carried by the mount bracket plate, a pair of spaced-apart gripper bracket arms carried by the gripper bracket body and a plurality of gripper bracket teeth provided in each of the gripper bracket arms.

12. The hoisting apparatus of claim 9 wherein the arm tightening mechanism comprises at least one ratchet strap engaging the gripper arms and a ratchet mechanism operably engaging the at least one ratchet strap; and further comprising at least one strap anchor bolt carried by the mount bracket plate and wherein the at least one ratchet strap is attached to the at least one strap anchor bolt.

13. The hoisting apparatus of claim wherein each of the gripper arms comprises a generally elongated gripper arm frame pivotally carried by the mount bracket plate, the gripper arm frame having an inner frame surface and a generally convex outer frame surface, and a plurality of gripper arm teeth provided on the inner frame surface of the gripper arm frame, and wherein the at least one ratchet strap engages the outer frame surface.

14. The hoisting apparatus of claim 9 wherein the boom actuating assembly comprises a boom actuating cylinder carried by the apparatus mounting bracket and a boom actuating piston extendable from the boom actuating cylinder and engaging the boom assembly.

15. The hoisting apparatus of claim 9 wherein the boom actuating assembly comprises a winch spool carried by the apparatus mounting bracket and a winch cable wound on the winch spool and attached to the boom assembly.

16. The hoisting apparatus of claim 9 wherein the boom actuating assembly is pivotally carried by the apparatus mounting bracket.

17. The hoisting apparatus of claim 9 wherein the boom arm comprises a tapered upper edge portion in cross-section and an elongated boom stabilizing flange extending along the upper edge portion of the boom arm.

18. A hoisting apparatus, comprising:

en apparatus mounting bracket including:

an elongated mount bracket plate having upper and lower ends and a longitudinal axis; and a first bracket attachment assembly carried by the mount bracket plate at the upper end and a second bracket attachment assembly carried by the mount bracket plate at the lower end, each of the first bracket attachment assembly and the second bracket attachment assembly having:

a pair of gripper arms each including a generally elongated gripper arm frame pivotally carried by the mount bracket plate, a generally convex outer frame surface, an inner frame surface and a plurality of gripper arm teeth on the inner frame surface, the pair of gripper arms disposed in a plane perpendicular to the longitudinal axis of the mount bracket plate;

a first bracket assembly mount arm carried by the mount bracket plate and extending beyond a first side edge of the mount bracket plate;

a second bracket assembly mount arm carried by the mount bracket plate and extending be second a second side edge of the mount bracket plate; and wherein the pair of gripper arms includes a first gripper arm pivotally carried by the first bracket assembly mount arm and a second gripper arm pivotally carried by the second bracket assembly mount arm; and an arm tightening mechanism including a pair of ratchet straps carried by the mount bracket plate and engaging the outer frame surface of a corresponding one of the gripper arms and a ratchet mechanism operably engaging the ratchet straps; and a gripper bracket having a gripper bracket body carried by the mount bracket plate between the first bracket assembly mount arm and the second bracket assembly mount arm, a pair of spaced-apart gripper bracket arms carried by the gripper bracket body beyond the first and second side edges, respectively, of the mount bracket plate and a plurality of gripper bracket teeth in each of the gripper bracket arms:

a boom assembly including:

an elongated boom arm pivotally carried by the apparatus mounting bracket at the first bracket attachment assembly and having a proximal arm end, a distal arm end and an arm midpoint substantially midway between the proximal arm end and the distal arm end, the boom arm having a tapered upper edge portion in cross-section and an elongated boom stabilizing flange extending along the upper, edge portion of the boom arm;

a hoisting cable carried by the distal arm end of the boom arm; and a boom fulcrum pivotally attaching the boom arm to the apparatus mounting bracket between the arm midpoint and the proximal arm end; and a boom actuating assembly carried by the apparatus mounting bracket at the second bracket attachment assembly and beneath the boom assembly, the boom actuating assembly operably engaging the boom assembly to selectively pivot the boom assembly about the boom fulcrum.

19. The hoisting apparatus of claim 18 wherein the boom fulcrum comprises a fulcrum collar carried by the mount bracket plate of the apparatus mounting bracket; an elongated, cylindrical fulcrum bearing inserted in the fulcrum collar; a fulcrum bolt extending through registering bolt openings in the fulcrum collar and the fulcrum bearing, respectively; and a fulcrum bearing opening extending laterally through the boom arm of the boom assembly and accommodating the fulcrum bearing.

20. The hoisting apparatus of claim 18 wherein the boom actuating assembly comprises an assembly mount platform carried by the apparatus mounting bracket, a rotatable winch spool carried by the apparatus mounting bracket, a crank shaft drivingly engaging the winch spool, a crank handle drivingly engaging the crank shaft, a double boom pulley carried by the proximal arm end of the boom arm a single platform pulley carried by the assembly mount platform and a winch cable wound on the winch spool and trained around the boom pulley and the platform pulley and attached to the assembly mount platform.

* * * * *